US008417161B2

(12) United States Patent
Iwamura

(10) Patent No.: US 8,417,161 B2
(45) Date of Patent: Apr. 9, 2013

(54) DEVELOPING DEVICE INCLUDING A CYLINDRICAL LAYER THICKNESS REGULATION MEMBER AND IMAGE FORMING APPARATUS INCLUDING THE DEVELOPING DEVICE

(75) Inventor: Takuya Iwamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 302 days.

(21) Appl. No.: 12/877,228

(22) Filed: Sep. 8, 2010

(65) Prior Publication Data

US 2011/0229216 A1 Sep. 22, 2011

(30) Foreign Application Priority Data

Mar. 16, 2010 (JP) ..... 2010-059741

(51) Int. Cl.
*G03G 15/08* (2006.01)

(52) U.S. Cl.
USPC ..... 399/274

(58) Field of Classification Search ..... 399/274, 399/284
See application file for complete search history.

(56) References Cited

U.S. PATENT DOCUMENTS 5,054,419 A * 10/1991 Itaya et al. ..... 399/274
6,473,588 B2 * 10/2002 Nakamura ..... 399/286
7,373,098 B2 * 5/2008 Choi et al. ..... 399/281
2007/0025777 A1 2/2007 Tomita et al.
2007/0086812 A1 * 4/2007 Iio et al. ..... 399/284

FOREIGN PATENT DOCUMENTS

JP 10-198171 A 7/1998
JP 11-167279 A 6/1999
JP 11-338259 A 12/1999
JP 2005-107475 A 4/2005
JP 2009-115999 A 5/2009

* cited by examiner

*Primary Examiner* — Quana M Grainger
(74) *Attorney, Agent, or Firm* — Sughrue Mion, PLLC

(57) ABSTRACT

A developing device that includes a developing member, a cylindrical layer thickness regulation member and a guide surface. The developing member retains a developer supplied from a developer accommodation portion and, while rotating, supplies the developer to an image-bearing body. The layer thickness regulation member comes up against the developer retained at the surface of the developing member and regulates a layer thickness of the developer. The guide surface guides developer that has been rendered excess by the layer thickness being regulated by the layer thickness regulation member toward the developer accommodation portion. The guide surface is provided such that an angle that is formed between the guide surface and a tangent of the layer thickness regulation member at a point of intersection of a line of extension of the guide surface with the layer thickness regulation member is at least 90°.

7 Claims, 9 Drawing Sheets

| No | 1 | 2 | 3 | 4 | 5 |
|---|---|---|---|---|---|
| SHAPE OF GUIDE SURFACE |  |  |  |  |  |
| DEPOSITS OF TONER NONE – O PRESENT – × | × | △ | ○ | ○ | ○ |

| No | 1 | 2 | 3 |
|---|---|---|---|
| SHAPE OF GUIDE SURFACE |  |  |  |
| DEPOSITS OF TONER IF REGULATION POLE IS DISPOSED AT UPSTREAM SIDE NONE – O PRESENT – x | × | × | × |
| DEPOSITS OF TONER IF REGULATION POLE IS DISPOSED AT DOWNSTREAM SIDE NONE – O PRESENT – x | ○ | ○ | ○ |

DEVELOPING DEVICE INCLUDING A CYLINDRICAL LAYER THICKNESS REGULATION MEMBER AND IMAGE FORMING APPARATUS INCLUDING THE DEVELOPING DEVICE

CROSS-REFERENCE TO RELATED APPLICATION

This application is based on and claims priority under 35 USC 119 from Japanese Patent Application No. 2010-059741 filed on Mar. 16, 2010.

BACKGROUND

1. Technical Field

The present invention relates to a developing device and an image forming device 2. Related Art Conventionally, there is a developing device in which a layer thickness regulation member is provided that regulates the thickness of a layer of developer adhering to a developing roller.

SUMMARY

A developing device relating to an aspect of the present invention includes: a developing member that retains at a surface thereof a developer supplied from a developer accommodation portion, in which the developer is accommodated, and that, while rotationally moving, supplies the developer to an image-bearing body on which an electrostatic latent image is formed and develops the electrostatic latent image; a cylindrical layer thickness regulation member that is disposed to oppose the developing member, extends in a rotation axis direction of the developing member, comes up against the developer retained at the surface of the developing member, and regulates a layer thickness of the developer; and a guide surface that guides developer that has been rendered excess by the layer thickness being regulated by the layer thickness regulation member toward the developer accommodation portion, wherein the guide surface is provided such that, viewed in the rotation axis direction of the developing member, an angle that is formed between the guide surface and a tangent of the layer thickness regulation member at a point of intersection of a line of extension of the guide surface with the layer thickness regulation member is at least 90°.

BRIEF DESCRIPTION OF THE DRAWINGS

An exemplary embodiment of the present invention will be described in detail based on the following figures, wherein.

DETAILED DESCRIPTION

Figure 1:
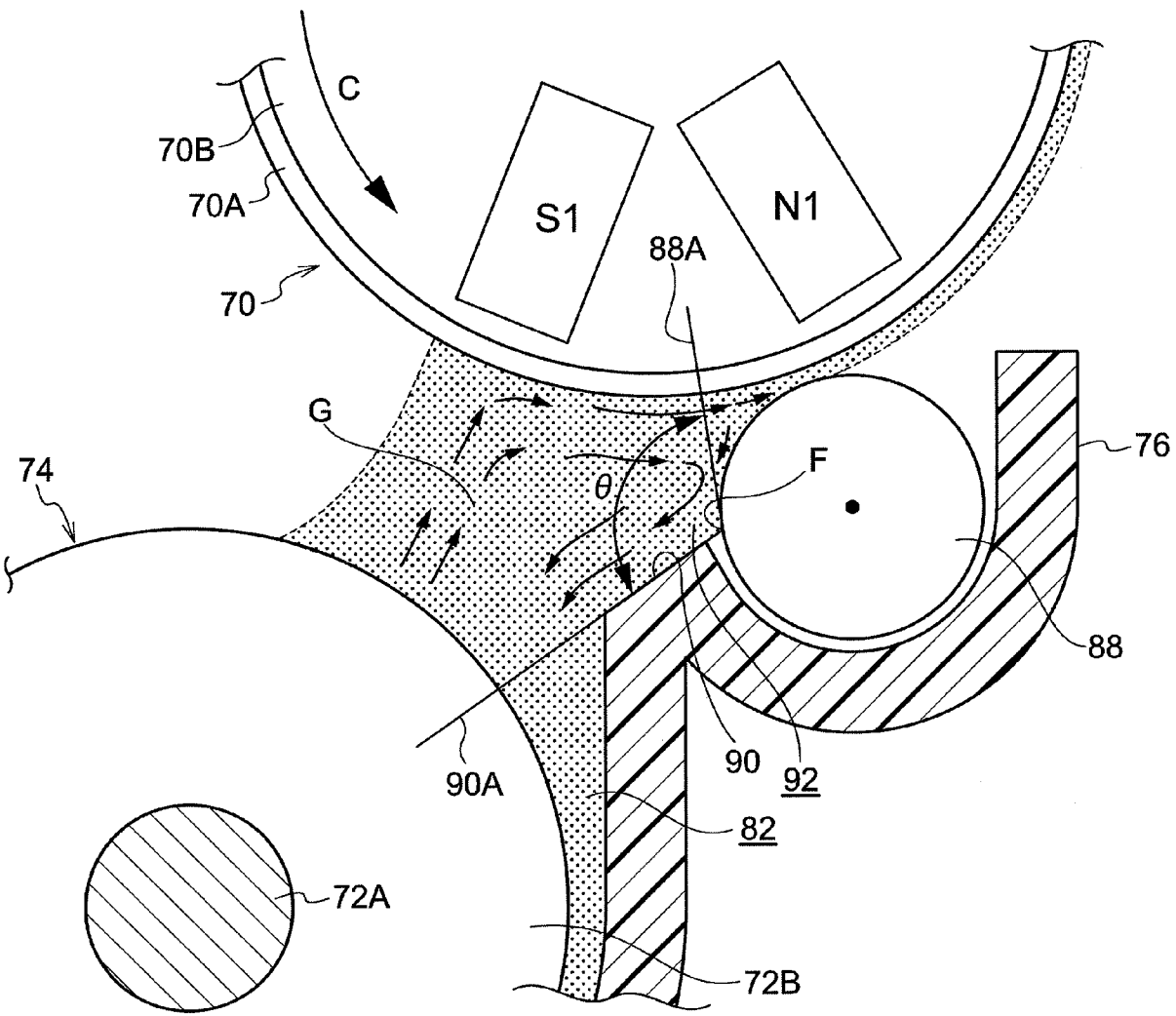
FIG. 1 is a magnified side view illustrating a developing device relating to an exemplary embodiment of the present invention.

Examples of a developing device and image forming device relating to an exemplary embodiment of the present invention are described in accordance with FIG. 1 to FIG. 9. The arrow UP shown in the drawings represents a vertical upward direction.

—Overall Structure—

Figure 9:
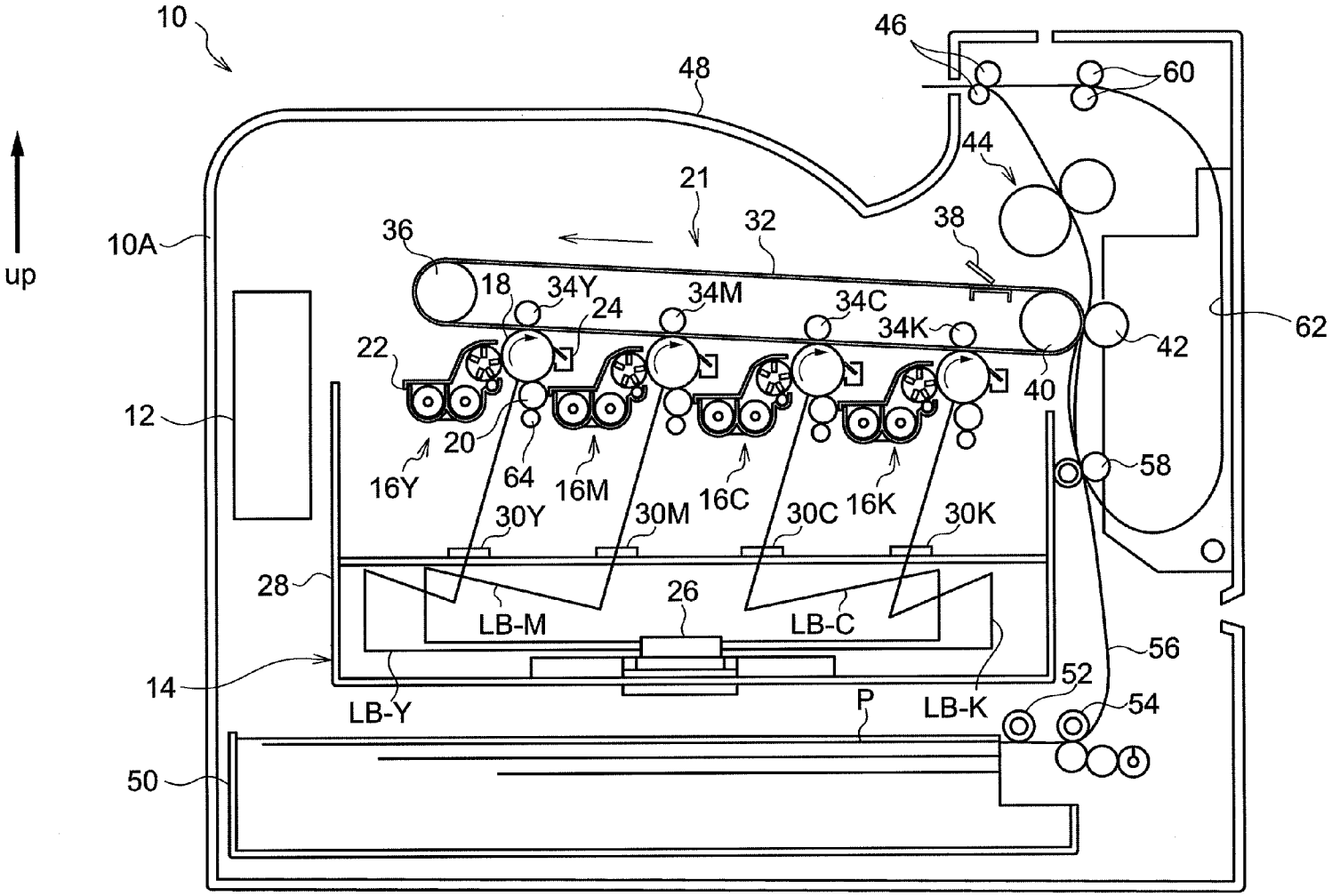
FIG. 9 is a schematic structural diagram illustrating an image forming device relating to the exemplary embodiment of the present invention.

As illustrated in FIG. 9, inside a device main body 10A of an image forming device 10, an image processor 12 that performs image processing on inputted image data is provided.

The image processor 12 processes the inputted image data into gradation data of the four colors yellow (Y), magenta (M), cyan (C) and black (K). An exposure device 14, which receives the processed gradation data and performs image exposure with laser lights LB, is disposed at the middle of the interior of the device main body 10A.

Four image forming units 16Y, 16M, 16C and 16K for yellow (Y), magenta (M), cyan (C) and black (K) are disposed above the exposure device 14, spaced in a horizontal direction. Where there is no need to distinguish between Y, M, C and K in the descriptions, the symbols Y, M, C and K are omitted.

The four image forming units 16Y, 16M, 16C and 16K are all similarly structured. Each of these image forming units includes an image-bearing body 18, a charging member 20, a developing device 22 and a cleaning blade 24. The image bearing body 18 is a cylindrical image-bearing body that is rotationally driven at a pre-specified speed. The charging member 20 is for uniformly electrostatically charging an outer peripheral surface of the image bearing body 18. An electrostatic latent image is formed at the charged outer peripheral surface of the image bearing body 18 by exposure with the above-mentioned exposure device 14. The developing device 22 develops the electrostatic latent image with toner of a pre-specified color and visualizes the electrostatic latent image as a toner image. The cleaning blade 24 cleans the outer peripheral surface of the image bearing body 18. At the lower side of the charging member 20, a cleaning member 64 is provided that touches against the cylindrical charging member 20 and cleans an outer peripheral face of the charging member 20.

The exposure device 14 is a structure that is common to the four image forming units 16Y, 16M, 16C and 16K, and includes four unillustrated semiconductor lasers. Laser lights LB-Y, LB-M, LB-C and LB-K are emitted from these semiconductor lasers in accordance with the gradation data.

The laser lights LB-Y, LB-M, LB-C and LB-K emitted from the semiconductor lasers are irradiated onto a polygon mirror 26, which is a rotating multi-faced mirror, via unillustrated f-θ lenses, and are deflected and scanned by the polygon mirror 26. The laser lights LB-Y, LB-M, LB-C and LB-K that have been deflected and scanned by the polygon mirror 26 pass through unillustrated focusing lenses and plural numbers of mirrors, and scanningly expose exposure points on the image-bearing bodies 18 from diagonally below.

Because the exposure device 14 scanningly exposes images onto the image bearing bodies 18 from below, there is a risk of toner and the like falling onto the exposure device 14 from the developing devices 22 of the four image forming units 16Y, 16M, 16C and 16K disposed thereabove and the like. Accordingly, the surroundings of the exposure device 14 are enclosed by a cuboid frame 28. Windows 30Y, 30M, 30C and 30K made of transparent glass are provided in upper portions of the frame 28. The windows 30Y, 30M, 30C and 30K allow the four laser lights LB-Y, LB-M, LB-C and LB-K to pass through toward the image bearing bodies 18 of the image forming units 16Y, 16M, 16C and 16K. The developing device 22 is described in detail below.

Above the image forming units 16Y, 16M, 16C and 16K, a first transfer unit 21 is provided. This first transfer unit 21 includes an endless intermediate transfer belt 32, a driving roller 40, a tensioning roller 36, a cleaning blade 38, and first transfer rollers 34Y, 34M, 34C and 34K. The intermediate transfer belt 32 is wound around the driving roller 40. The driving roller 40 is rotationally driven and turns the intermediate transfer belt 32 in the direction of the arrow. The tensioning roller 36 applies tension to the intermediate transfer belt 32. The cleaning blade 38 cleans an outer periphery surface of the intermediate transfer belt 32. The first transfer rollers 34Y, 34M, 34C and 34K are disposed to sandwich the intermediate transfer belt 32 at the opposite side thereof from the image bearing bodies 18Y, 18M, 18C and 18K.

The toner images of the colors yellow (Y), magenta (M), cyan (C) and black (K) that are sequentially formed on the image bearing bodies 18 of the image forming units 16Y, 16M, 16C and 16K are superposedly transferred onto the intermediate transfer belt 32 by the four first transfer rollers 34Y, 34M, 34C and 34K.

A second transfer roller 42 is provided to sandwich the intermediate transfer belt 32 at the opposite side thereof from the driving roller 40. The toner images of the colors yellow (Y), magenta (M), cyan (C) and black (K) that have been superposedly transferred onto the intermediate transfer belt 32 are conveyed by the intermediate transfer belt 32, nipped between the driving roller 40 and the second transfer roller 42, and second-transferred on to a sheet member P serving as a recording medium, which is conveyed along a paper conveyance path 56.

A fixing device 44 is disposed at a downstream side in a conveyance direction of the sheet member P (hereinafter simply referred to as the downstream side) relative to the second transfer roller 42. The fixing device 44 fixes the toner image transferred onto the sheet member P to the sheet member P by heat and pressure.

An ejection roller 46 is disposed at the downstream side of the fixing device 44. The ejection roller 46 ejects the sheet member P onto which the toner image has been fixed, to an ejection section 48 provided at a top portion of the device main body 10A of the image forming device 10.

A paper supply member 50, in which the sheet members P are stacked, is provided at a lower side of the interior of the device main body 10A of the image forming device 10. A paper supply roller 52 that feeds the sheet members P stacked in the paper supply member 50 out to the paper conveyance path 56 is also provided, and a separation roller 54 is disposed at the downstream side of the paper supply roller 52. The separation roller 54 separates and conveys the sheet members P one at a time. A positioning roller 58 is disposed at the downstream side of the separation roller 54. The positioning roller 58 matches up conveyance timings. Thus, a sheet member P that is supplied from the paper supply member 50 is fed, by the positioning roller 58 rotating, to a position of contact between the intermediate transfer belt 32 and the second transfer roller 42 (a second transfer position) with a pre-specified timing.

A conveyance roller 60 is disposed adjacent to the ejection roller 46. The conveyance roller 60 conveys a sheet member P, to one face of which an image has been fixed by the fixing device 44, to a two-sided printing paper conveyance path 62 rather than the ejection roller 46 simply ejecting the sheet member P to the ejection section 48. Hence, the sheet member P that is conveyed along the two-sided printing paper conveyance path 62 is again conveyed to the positioning roller 58 in a state in which the sheet member P has been inverted between front and back. A toner image is transferred and fixed, this time, to a rear face of the sheet member P, and the sheet member P is ejected to the ejection section 48.

According to this structure, an image is formed on a sheet member P as follows.

First, gradation data of the respective colors is sequentially outputted from the image processor 12 to the exposure device 14. Then the laser lights LB-Y, LB-M, LB-C and LB-K emitted from the exposure device 14 in accordance with the gradation data scanningly expose the outer peripheral faces of the image bearing bodies 18 that have been charged up by the charging members 20. Thus, electrostatic latent images are formed at the outer peripheral faces of the image bearing bodies 18. The electrostatic latent images formed on the image bearing bodies 18 are visualized as toner images of the colors yellow (Y), magenta (M), cyan (C) and black (K) by the developing devices 22Y, 22M, 22C and 22K, respectively.

The toner images of the colors yellow (Y), magenta (M), cyan (C) and black (K) that have been formed on the image bearing bodies 18 are superposedly transferred onto the intermediate transfer belt 32 by the first transfer rollers 34 of the first transfer unit 21 disposed along the top of the image forming units 16Y, 16M, 16C and 16K.

The toner images of the respective colors that have been superposedly transferred onto the intermediate transfer belt 32 that is turning are second-transferred by the second transfer roller 42 to a sheet member P, which is conveyed from the paper supply member 50 to the paper conveyance path 56 by the paper supply roller 52, the separation roller 54 and the positioning roller 58 with a pre-specified timing.

The sheet member P to which the toner image has been transferred is conveyed to the fixing device 44. The toner image transferred onto the sheet member P is fixed to the sheet member P by the fixing device 44. After being fixed, the toner image is ejected by the ejection roller 46 to the ejection section 48 provided at the upper portion of the device main body 10A of the image forming device 10.

If images are to be formed on both faces of the sheet member P, the sheet member P on one face of which an image has been fixed by the fixing device 44 is not simply ejected to the ejection section 48 by the ejection roller 46 but the conveyance path is switched and the sheet member P is conveyed via the conveyance roller 60 to the two-sided printing paper conveyance path 62. The sheet member P is then conveyed along the two-sided printing paper conveyance path 62. Thus, the sheet member P is flipped front-to-back, and the sheet member P is again conveyed to the positioning roller 58. This time, a toner image is transferred onto the rear face of the sheet member P and fixed, and after this toner image has been transferred and fixed, the sheet member P is ejected to the ejection section 48 by the ejection roller 46.

—Structure of Principal Portions—

Figure 3:
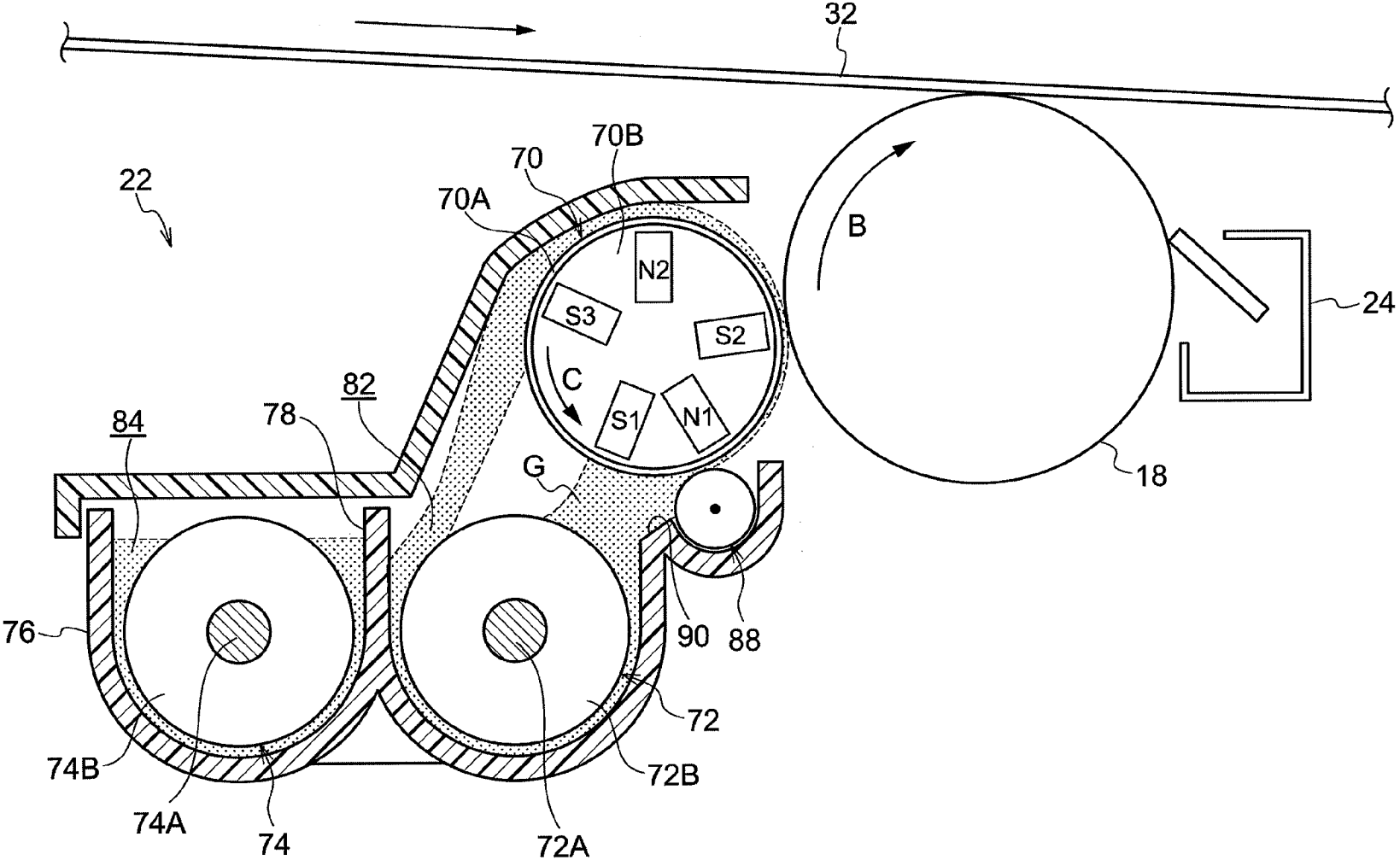
FIG. 3 is a side view illustrating the developing device relating to the exemplary embodiment of the present invention.

As illustrated in FIG. 3, each developing device 22 includes a developing roller 70, a first agitation and conveyance auger 72, a second agitation and conveyance auger 74 and a casing 76. The developing roller 70, which is disposed so as to oppose the image-bearing body 18, serves as an example of a developing member. The first agitation and conveyance auger 72 is disposed below the developing roller 70 and supplies a two-component developer G (hereinafter simply referred to as the developer G) to the developing roller 70. The second agitation and conveyance auger 74 is disposed adjacent to the first agitation and conveyance auger 72. The casing 76 accommodates the developing roller 70, the first agitation and conveyance auger 72 and the second agitation and conveyance auger 74. Herein, the developer G contains toner and magnetic carrier particles as the principal components thereof.

The first agitation and conveyance auger 72 and the second agitation and conveyance auger 74 include rotating shafts 72A and 74A, respectively. The rotating shafts 72A and 74A are each rotatably supported at side walls of the casing 76. Helical vanes 72B and 74B with pre-specified pitches are helically formed on the rotating shafts 72A and 74A of the first agitation and conveyance auger 72 and the second agitation and conveyance auger 74.

Respective unillustrated gears are fixed to end portions of the rotating shafts 72A and 74A. Rotary force from an unillustrated motor is transmitted to the gears and, by means of the gears, the first agitation and conveyance auger 72 and the second agitation and conveyance auger 74 are each rotated. Thus, the developer G accommodated in the casing 76 is conveyed while being agitated by the helical vanes 72B and 74B.

More specifically, a partition wall 78 is formed between the first agitation and conveyance auger 72 and the second agitation and conveyance auger 74. The partition wall 78 stands upward from a floor portion of the casing 76. A first agitation path 82 and a second agitation path 84 are formed by this partition wall 78. The first agitation path 82, in which the first agitation and conveyance auger 72 is disposed, serves as an example of a developer accommodation portion. The second agitation and conveyance auger 74 is disposed in the second agitation path 84. Each of two length direction end portions of the partition wall 78 are opened and connect the first agitation path 82 with the second agitation path 84.

According to this structure, the developer G is conveyed while being agitated in each of the first agitation path 82 and the second agitation path 84 by rotation of the first agitation and conveyance auger 72 and the second agitation and conveyance auger 74. Accordingly, the developer G circulates between the first agitation path 82 and the second agitation path 84.

Figure 2:
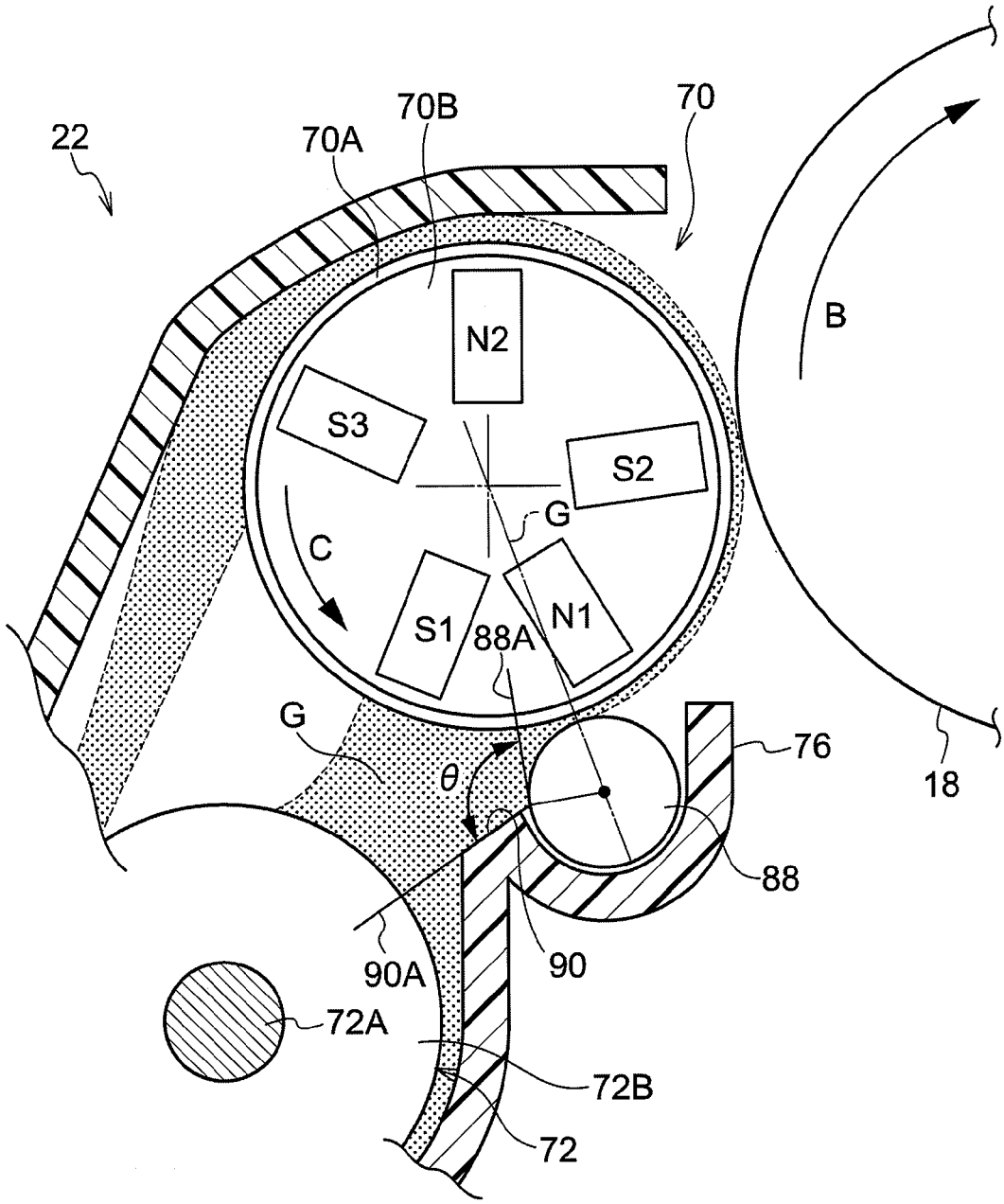
FIG. 2 is a magnified side view illustrating the developing device relating to the exemplary embodiment of the present invention.

As illustrated in FIG. 2, the developing roller 70 is disposed such that a gap (a development gap) is formed between the developing roller 70 and the image bearing body 18. The developing roller 70 includes a cylindrical magnetic roller 70B and a rotating sleeve 70A. The magnetic roller 70B serves as an example of a magnetism generation member. The rotating sleeve 70A covers the magnetic roller 70B and serves as an example of a rotating member that rotates around the magnetic roller 70B.

The rotating sleeve 70A rotates in the direction of arrow C shown in FIG. 2 about the axis of the magnetic roller 70B, which is rotation in the opposite direction to the image bearing body 18, which turns in the direction of arrow B.

Five permanent magnets are radially disposed inside the magnetic roller 70B, along the circumferential direction of the rotating sleeve 70A. The permanent magnets each have a south pole or north pole formed at the surface side thereof. A development pole S2 is formed at a position opposing the image bearing body 18. A conveyance pole N2 is disposed adjacent to the development pole S2 along the direction of rotation C of the rotating sleeve 70A. A pickoff pole S3 is disposed adjacent to the conveyance pole N2. Magnets of a drawing pole S1 and a layer thickness regulation pole N1 are disposed in this order adjacent to the pickoff pole S3. Herein, the drawing pole S1, development pole S2 and pickoff pole S3 are all south poles and the layer thickness regulation pole N1 and the conveyance pole N2 are both north poles, and a negative development bias voltage is applied to the developing roller 70.

A layer thickness regulation member 88, with a cylindrical shape extending in the direction of the rotation axis of the rotating sleeve 70A (hereinafter simply referred to as the axial direction) is disposed so as to oppose the rotating sleeve 70A.

The layer thickness regulation member 88 is formed with a magnetic body. The two ends of the layer thickness regulation member 88 are non-rotatably supported at the casing 76. A distal end portion of the layer thickness regulation pole N1 (the end portion thereof that opposes an inner peripheral face of the rotating sleeve 70A) is disposed at a downstream side in the direction of rotation of the rotating sleeve 70A (hereinafter simply referred to as the rotation direction) relative to a line G that joins the center of the layer thickness regulation member 88 with the center of rotation of the rotating sleeve 70A.

As illustrated in FIG. 1, a guide surface 90 is formed at an inner face of the casing 76. A distal end portion of the guide surface 90 opposes the outer peripheral face of the layer thickness regulation member 88, and the guide surface 90 guides excess developer G that has come up against the layer thickness regulation member 88 and turned back toward the first agitation path 82. The guide surface 90 is disposed so as to oppose the outer peripheral face of the rotating sleeve 70A, and is formed so as to sandwich the developer G between the outer peripheral face of the rotating sleeve 70A and the guide surface 90 (forming a "wedge shape").

The guide surface 90 is provided such that, viewed in the axial direction, an angle θ that is formed between a line of extension 90A of the guide surface 90 (the guide surface 90) and a tangent 88A of the layer thickness regulation member 88 at a point of intersection F (FIG. 1) of the line of extension of the guide surface 90 with the layer thickness regulation member 88 is at least 90°.

—Operation—

Next, operation of the developing device 22 is described.

As illustrated in FIG. 3, the developer G is conveyed while being agitated in the first agitation path 82 and the second agitation path 84 by the rotations of the first agitation and conveyance auger 72 and the second agitation and conveyance auger 74, respectively, and circulates between the first agitation path 82 and the second agitation path 84.

When the rotating sleeve 70A turns in the rotation direction C, first, the developer G in the first agitation path 82 is drawn up by the drawing pole S1 and is attracted to the surface of the rotating sleeve 70A.

At the surface of the rotating sleeve 70A, a magnetic field is formed from the layer thickness regulation pole N1 to the development pole S2, a magnetic field is formed from the layer conveyance pole N2 to the development pole S2, a magnetic field is formed from the conveyance pole N2 to the pickoff pole S3, and a magnetic field is formed from the layer thickness regulation pole N1 to the drawing pole S1.

Accordingly, the developer G that has been attracted to the surface of the rotating sleeve 70A is arranged along the magnetic force lines at the surface of the rotating sleeve 70A, spikes up, and forms a magnetic brush.

The magnetic brush that is formed on the surface of the rotating sleeve 70A in the vicinity of the drawing pole S1 is conveyed toward the layer thickness regulation pole N1 in association with the rotating sleeve 70A turning with arrow C.

Between the drawing pole S1 and the layer thickness regulation pole N1, the layer thickness regulation member 88 is provided so as to oppose the rotating sleeve 70A and form a pre-specified gap therebetween. Therefore, the developer G being conveyed toward the layer thickness regulation pole N1 by the rotating sleeve 70A turning with arrow C comes up against the layer thickness regulation member 88, and the layer thickness is regulated. The developer G whose layer thickness has been regulated at the layer thickness regulation member 88 is conveyed from the layer thickness regulation pole N1 to the development pole S2, from the development pole S2 to the conveyance pole N2, and from the conveyance pole N2 to the pickoff pole S3.

More specifically, toner on the magnetic brush migrates to the image bearing body 18 at the vicinity of the development pole S2, the electrostatic latent image formed on the image bearing body 18 is visualized as a toner image, and a magnetic brush that is mostly the carrier alone is left on the surface of the rotating sleeve 70A. As the rotating sleeve 70A turns, the developer G that is mostly the carrier alone falls from the surface of the rotating sleeve 70A at the pickoff pole S3 and returns to the inside of the first agitation path 82.

Now, as illustrated in FIG. 1, the developer G that is passing through the gap between the layer thickness regulation member 88 and the rotating sleeve 70A is attracted to the layer thickness regulation pole N1, which is disposed at the rotation direction downstream side relative to the layer thickness regulation member 88. Therefore, the layer thickness of the developer G on the rotating sleeve 70A is regulated and the height of the magnetic brush is made uniform without the developer G becoming congested in the gap between the layer thickness regulation member 88 and the rotating sleeve 70A.

Excess developer G that has not managed to pass through the gap between the layer thickness regulation member 88 and the rotating sleeve 70A comes up against the layer thickness regulation member 88, turns around, flows along the guide surface 90, and is returned to the first agitation path 82. As mentioned above, the guide surface 90 is provided such that, viewed in the axial direction, the angle θ that is formed between the line of extension 90A of the guide surface 90 and the tangent 88A of the layer thickness regulation member 88 at the point of intersection F of the line of extension of the guide surface 90 with the layer thickness regulation member 88 is at least 90°. Therefore, the developer G is unlikely to become congested in a gap portion 92 that is structured by the outer peripheral face of the layer thickness regulation member 88 and the guide surface 90, and occurrences of toner deposits are suppressed.

Furthermore, because the developer G turns back along the guide surface 90, a packing pressure that acts on the developer G between the rotating sleeve 70A and the layer thickness regulation member 88 is kept from becoming larger than necessary.

A relationship between the angle θ formed by the line of extension 90A of the guide surface 90 and the tangent 88A of the layer thickness regulation member 88 at the point of intersection of the line of extension of the guide surface 90 with the layer thickness regulation member 88, as viewed in the axial direction, and accretions of toner that occur in the gap portion 92 structured by the outer peripheral face of the layer thickness regulation member 88 and the guide surface 90 was investigated. First, altering the angle θ to a number of levels with which the guide surface does not oppose the outer peripheral face of the rotating sleeve was investigated.

Figure 4:
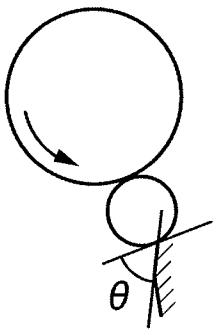
FIG. 4 is a diagram of results of evaluation of the developing device relating to the exemplary embodiment of the present invention and developing devices that serve as comparative examples.
Figure 4:
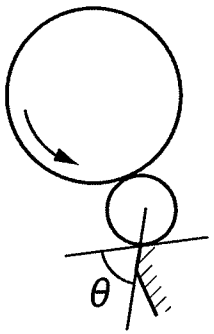
Figure 4:
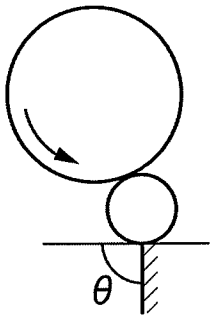
Figure 4:
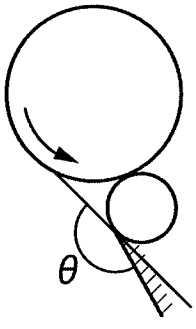
Figure 4:
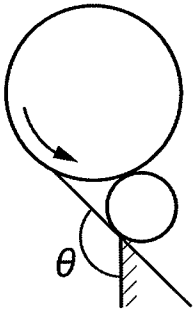

As illustrated in FIG. 4, guide surfaces were disposed such that the angle θ increased from No. 1 to No. 5. As shown by No. 3 to No. 5, it was seen that deposits of toner do not occur (i.e., are below tolerance amounts) with angles θ of 90° or more.

Figure 8:
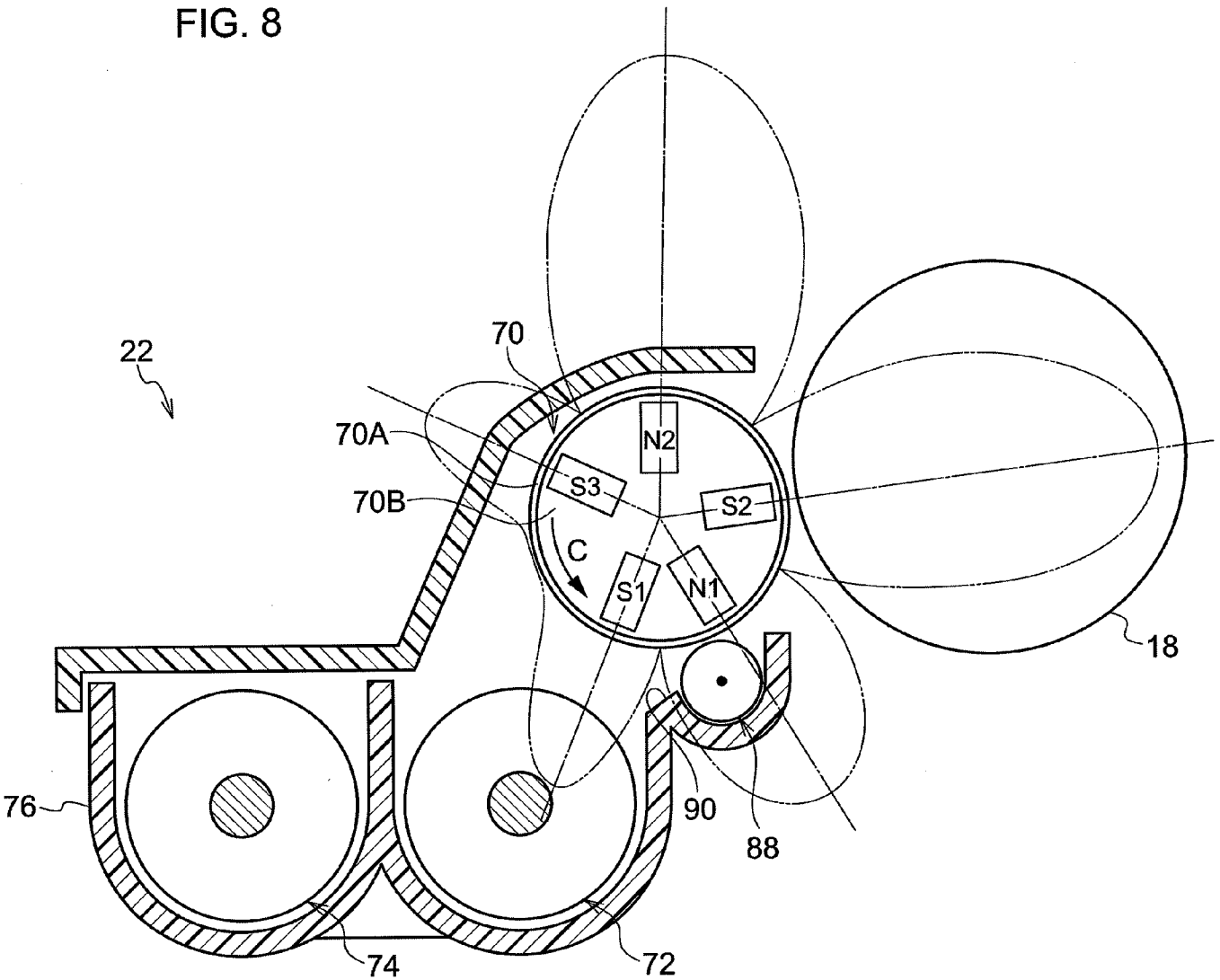
FIG. 8 is a side view illustrating the developing device relating to the exemplary embodiment of the present invention.

Next, given the guide surface being a structure that opposes the outer peripheral face of the rotating sleeve (the so-called "wedge shape"), altering the angle θ to three levels of at least 90° was investigated with the layer thickness regulation pole N1 being disposed at the rotation direction upstream side relative to the layer thickness regulation member (see FIG. 7) and with the layer thickness regulation pole N1 being disposed at the rotation direction downstream side relative to the layer thickness regulation member as in the present exemplary embodiment (see FIG. 8).

Figure 5:
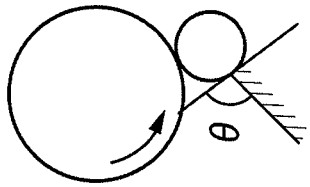
FIG. 5 is a diagram of results of evaluation of the developing device relating to the exemplary embodiment of the present invention and developing devices that serve as comparative examples.
Figure 5:
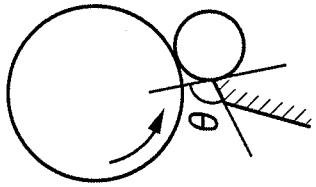
Figure 5:
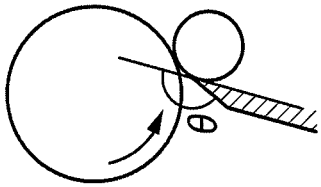

As illustrated by No. 1 to No. 3 in FIG. 5, regardless of the angle θ, when the layer thickness regulation pole N1 is disposed at the rotation direction upstream side relative to the layer thickness regulation member, deposits of toner occur. In contrast, regardless of the angle θ, when the layer thickness regulation pole N1 is disposed at the rotation direction downstream side relative to the layer thickness regulation member, it was seen that deposits of toner do not occur.

Next, the guide surface was disposed so as to oppose the outer peripheral face of the rotating sleeve (the so-called "wedge shape"), and relative positions of the layer thickness regulation pole N1 and the layer thickness regulation member were altered with the angle θ being fixed at 90°. A case when the layer thickness regulation pole N1 opposes the center of the layer thickness regulation member (when the layer thickness regulation pole N1 is disposed along the line G shown in FIG. 2) was represented as 0°, cases when the layer thickness regulation pole N1 is disposed at the rotation direction upstream side relative to the layer thickness regulation member were represented as negative values, and cases when the layer thickness regulation pole N1 is disposed at the rotation direction downstream side relative to the layer thickness regulation member as in the present exemplary embodiment were represented as positive values.

Figure 6:
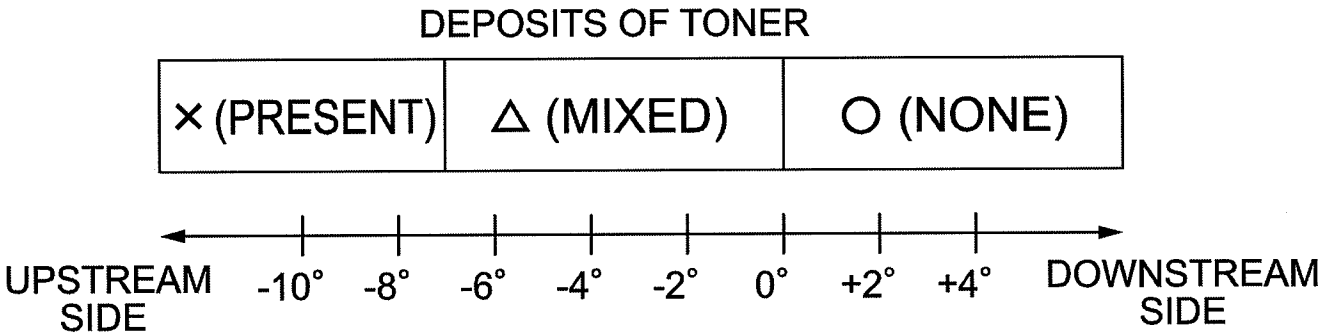
FIG. 6 is a diagram of results of evaluation of the developing device relating to the exemplary embodiment of the present invention and developing devices that serve as comparative examples.
Figure 7:
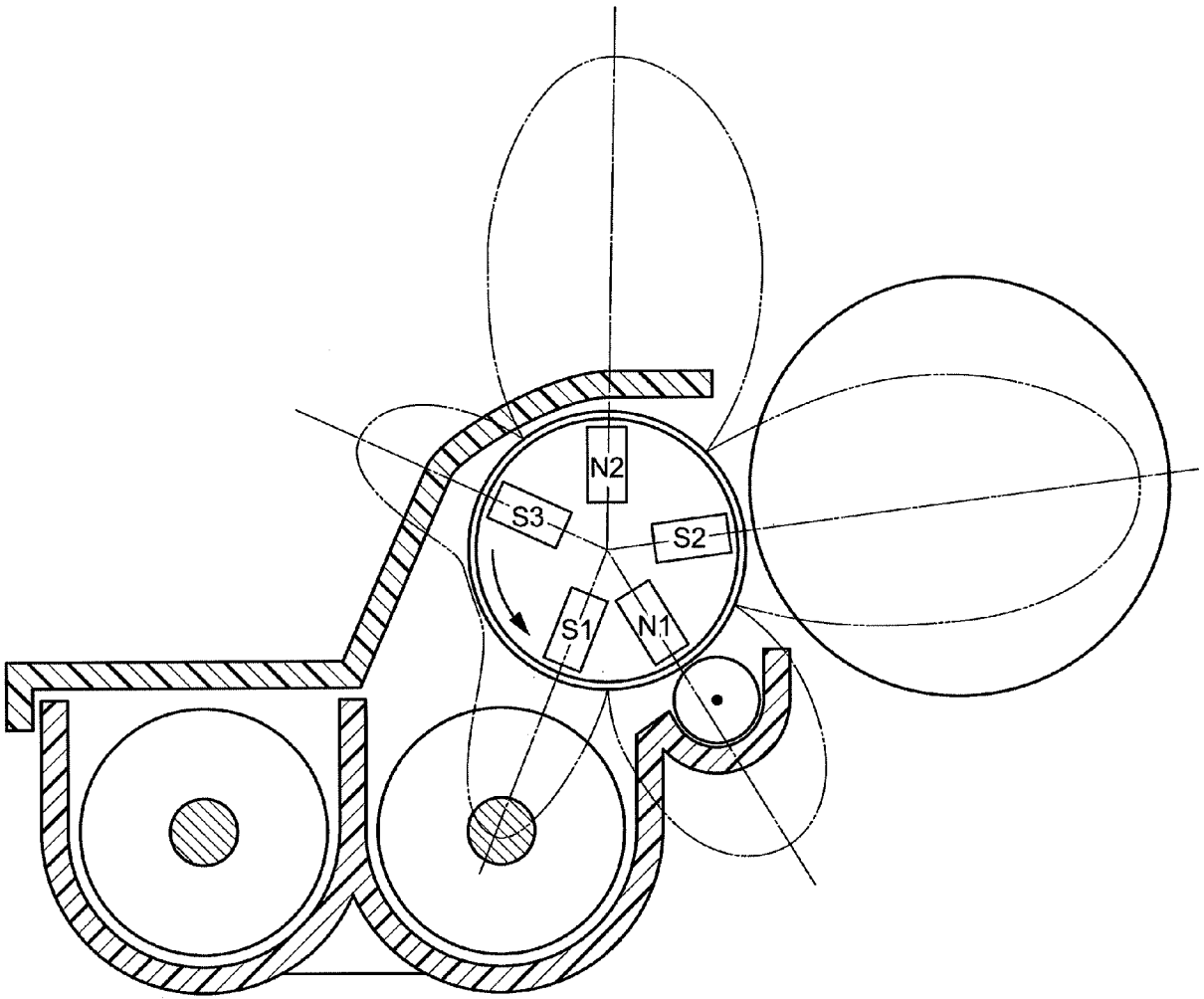
FIG. 7 is a side view illustrating a developing device that is a comparative example with the developing device relating to the exemplary embodiment of the present invention.

As illustrated in FIG. 6, deposits of toner occurred when the layer thickness regulation pole N1 was disposed at the rotation direction upstream side relative to the layer thickness regulation member, or cases of occurrence and non-occurrence were mixed. In contrast, it was seen that when the layer thickness regulation pole N1 was disposed at the rotation direction downstream side relative to the layer thickness regulation member, deposits of toner did not occur.

As described above, the guide surface 90 is provided such that, viewed in the axial direction, the angle θ that is formed between the line of extension 90A of the guide surface 90 and the tangent 88A of the layer thickness regulation member 88 at the point of intersection F of the line of extension of the guide surface 90 with the layer thickness regulation member 88 is at least 90°. Therefore, congestion of developer G that has been rendered excess, by the layer thickness being regulated by the layer thickness regulation member 88, in the gap portion 92, which is structured by the outer peripheral face of the layer thickness regulation member 88 and the guide surface 90, is suppressed with a simple structure.

Because congestion of the developer G is suppressed, deposits of toner in the gap portion 92 are unlikely to occur.

Because deposits of toner do not occur, density variations in printed images due to aggregated deposited toner adhering to the developing roller 70, by whatever mechanism, are suppressed.

The developer G coming up against the layer thickness regulation member 88 turns back along the guide surface 90. Therefore, the packing pressure that acts on the developer G between the rotating sleeve 70A and the layer thickness regulation member 88 is kept from becoming larger than necessary. Thus, deterioration of the developer G is suppressed.

Because the layer thickness regulation member 88 has a cylindrical shape, by comparison with a case in which the cross-section thereof is rectangular, an installation attitude is secure and fixing components are simplified.

Because the layer thickness regulation member 88 is a magnetic body, the layer thickness regulation member 88 is magnetized by magnetic force of the magnetic roller 70B. Therefore, the layer thickness of the developer G is regulated by magnetic force of the magnetic roller 70B and magnetic force of the layer thickness regulation member 88. Consequently, the gap can be made wider than if the layer thickness regulation member 88 is a non-magnetic body. Therefore, accumulations of foreign matter in the gap are suppressed and adjustment of a regulation amount of the layer thickness of the developer G is simple.

Furthermore, because the layer thickness regulation member 88 is a magnetic body, it is a cheaper member than if it is a non-magnetic body.

A particular exemplary embodiment of the present invention has been described in detail. However, the present invention is not to be limited to this exemplary embodiment, and it will be clear to the ordinary practitioner that there are numerous other embodiments within the technical scope of the present invention. For example, in the exemplary embodiment described above, a magnetic body is used as the layer thickness regulation member 88. However, this is not to be particularly limiting and a non-magnetic body is possible.

Further, in the exemplary embodiment described above, a structure is described in which the developer G is sandwiched between the outer peripheral face of the rotating sleeve 70A and the guide surface 90 (which form the so-called "wedge shape"). However, this structure is not to be particularly limiting; the developer G need not be sandwiched between the outer peripheral face of the rotating sleeve and the guide surface (for example, see the structures illustrated in No. 3 to No. 5 of FIG. 4.

What is claimed is:

1. A developing device comprising:

a developing member that retains at a surface thereof a developer supplied from a developer accommodation portion, in which the developer is accommodated, and that, while rotationally moving, supplies the developer to an image-bearing body on which an electrostatic latent image is formed and develops the electrostatic latent image;

a cylindrical layer thickness regulation member that is disposed to oppose the developing member, extends in a rotation axis direction of the developing member, comes up against the developer retained at the surface of the developing member, and regulates a layer thickness of the developer; and a guide surface that guides developer that has been rendered excess by the layer thickness being regulated by the layer thickness regulation member toward the developer accommodation portion, wherein the guide surface is provided such that, viewed in the rotation axis direction of the developing member, an angle that is formed between the guide surface and a tangent of the layer thickness regulation member at a point of intersection of a line of extension of the guide surface with the layer thickness regulation member is at least 90°, wherein the line of extension of the guide surface is parallel to and in contact with the guide surface, and wherein the line of extension of the guide surface extends from the point of intersection towards a direction upstream of the point of intersection when viewed along a direction parallel to the rotational direction of the developing member.

2. The developing device according to claim 1, wherein the developing member comprises a magnetism generation member at which a plurality of magnets are fitted in a circumferential direction, and a rotating member that rotates about the magnetism generation member while bearing developer at a surface thereof, a drawing pole and a layer thickness regulation pole are provided at the magnetism generation member, the drawing pole drawing developer that is supplied from the developer accommodation portion, and the layer thickness regulation pole, which is at a downstream side relative to the drawing pole in a direction of rotation of the rotating member, regulating the layer thickness of the developer, and the layer thickness regulation pole is disposed at a downstream side in the direction of rotation of the developing member relative to a line that joins a center of the layer thickness regulation member with a center of rotation of the rotating member.

3. The developing device according to claim 1, wherein the layer thickness regulation member is a magnetic body.

4. The developing device according to claim 2, wherein the layer thickness regulation member is a magnetic body.

5. An image forming device comprising:

an image bearing body at a surface of which an electrostatic latent image is formed;

a developing device according to claim 1 that supplies the developer to the image bearing body and visualizes the electrostatic latent image as an image; and a transfer member that transfers the image formed at the surface of the image bearing body to a transfer object.

6. An image forming device comprising:

an image bearing body at a surface of which an electrostatic latent image is formed;

a developing device according to claim 2 that supplies the developer to the image bearing body and visualizes the electrostatic latent image as an image; and a transfer member that transfers the image formed at the surface of the image bearing body to a transfer object.

7. An image forming device of claim 5, wherein the layer thickness regulation member of the developing device is a magnetic body.

* * * * *